US005509157A

United States Patent [19]

Story

[11] Patent Number: 5,509,157

[45] Date of Patent: Apr. 23, 1996

[54] PILLOW CASE WITH ANIMAL OR OTHER CHARACTER APPENDAGES

[76] Inventor: Lana Story, 7890 Mill Creek Rd., Surfside, S.C. 29575

[21] Appl. No.: 158,963

[22] Filed: Nov. 29, 1993

[51] Int. Cl.[6] ..... A47G 9/00

[52] U.S. Cl. ..... 5/490; D6/601; 5/636

[58] Field of Search ..... 5/490, 636, 482, 5/640, 644; D6/601

[56] References Cited

U.S. PATENT DOCUMENTS

| | | | |
|---|---|---|---|
| D. 311,472 | 10/1990 | Giles | D6/601 |
| 4,768,245 | 9/1988 | Dutton | 5/490 |
| 4,959,880 | 10/1990 | Tesch | 5/490 |
| 4,968,279 | 11/1990 | Smith | 5/636 |
| 5,027,457 | 7/1991 | Sweet | 5/490 |
| 5,157,799 | 10/1992 | Aird | 5/490 |
| 5,184,362 | 2/1993 | Yager et al. | 5/490 |

*Primary Examiner*—Alexander Grosz
*Attorney, Agent, or Firm*—Floyd E. Ivey

[57] ABSTRACT

The present invention relates to pillow cases utilized for both decorative and functional sleeping purposes. The pillow case is adapted to receive caricature animal and other caricature character appendages principally at the pillow case corners. The pillow case corners are rounded to permit attachment of such appendages so that the appendages project to the side and thus do not unduly impact, infringe or intrude upon the functional sleeping area of the pillow case.

4 Claims, 2 Drawing Sheets

PILLOW CASE WITH ANIMAL OR OTHER CHARACTER APPENDAGES

FIELD OF THE INVENTION

The present invention relates generally to pillow cases and relates in particular to pillow cases adapted to receive caricature animal and other caricature character appendages so that the attached appendages do not unduly intrude into the sleep area of the pillow case.

BACKGROUND OF THE INVENTION

Pillow cases are known which accommodate pillows for sleeping purposes or which provide decoration without use for sleeping purposes. Others are known which are decorative and which are also used for sleep purposes including those decorated in a manner wherein animal or other character caricatures are depicted. However, applications seen result in an undesirable intrusion into the sleeping area by attached character caricature appendages or decorations. Applications known involve pillow cases substantially of a rectangular shape with corners formed by a 90° (ninety degree) angle. Caricature animal and other caricature character appendages, such as legs, are generally attached to the pillow case in an orientation placing the appendage into the sleeping area of the pillow. The appendage generally extends perpendicularly from the long side of the rectangular pillow case thus intruding into the sleeping area. The present application permits addition of appendages in a manner such that the sleeping area of the pillow is not unduly impacted. Pillow case configurations permitting attachment of caricature appendages are not known to exist in a manner similar to the configuration presented herein. There is no particular manufacturer or supplier known or prior art known which provides pillow cases for the purposes and/or in a configuration similar to that addressed herein. There are no patents known which address pillow cases. Hence there is no present identification of related art and no related art known to disclose in accordance with 37 CFR 1.97.

SUMMARY OF THE INVENTION

In accordance with the present invention, a pillow case is provided which permits attachment of caricature animal and other character appendages principally including heads and legs in a manner such that the sleeping area of the pillow is not unduly impacted.

The present invention comprises an improvement to known pillow cases used for both decorative and sleep purposes wherein the improvement comprises rounded pillow case corners and a separate bottom pillow case panel facing. The preferred embodiment of the pillow case is substantially rectangular in shape. However, unlike known pillows used for such purposes, the corners are not formed of 90 degree angle but rather are rounded. Additionally, a bottom pillow case panel facing is utilized. The bottom pillow case panel facing is the same width as the pillow case panel, has corners formed to correspond to the corners of the pillow case panel corners and has a depth of generally the radius of the pillow case corner. A bottom pillow case panel facing is affixed to the second or inside surface at the bottom end of the pillow case panel providing added strength to the pillow case and protection of the caricature appendages during insertion and extraction of the pillow into and from the pillow case.

The combination of the new rounded pillow case corners and the bottom pillow case panel facing permits attachment of caricature appendages in a manner such that the sleeping area of the pillow in not unduly impacted, infringed or intruded upon. The new rounded pillow case corner permits the attachment of caricature appendages so that the angle between an axis extending away from the pillow case and along the appendage and the long side of the pillow case forms an angle of approximately 135 degrees. This is contrasted with the orientation, on known pillow cases, wherein caricature appendages are attached so that the angle between an axis extending away from the pillow case and along the appendage and the long side of the pillow case forms approximately a 90 degree angle thus generally extending perpendicularly from the long side of the rectangular pillow case and intruding into the sleeping area. A particular improvement is recognized when the appendages are oriented at 135 degrees in that the appendage extends to the side of the sleeping area rather than intruding into the sleeping area.

The improvement is particularly directed to the adaption of decorative or caricature character appendages to pillow cases to create the impression of large stuffed animals or characters while permitting routine use of the pillow case for sleep purposes. The components of the pillow case include two pillow case panels and one bottom pillow case facing. The method of assembly of the pillow case with caricature appendages includes first the attachment of caricature legs, wings, feet or similar appendages at the corners of and a head at the center of the top end of one of the pillow case panels. The appendage overlays the pillow case panel and is attached by means, usually by sewing or gluing, to the pillow case panel. A bottom pillow case facing is placed over the appendages at the bottom end of the pillow case panel and is attached in place. A bottom pillow case facing is placed at the bottom end of a second panel and is attached by means, usually by sewing or gluing, to the pillow case panel. The bottom pillow case facing corners are rounded and are aligned with the rounded corners of the respective pillow case panels. The appendages and bottom pillow case facing are attached to the surface of the pillow case panel so as to be on the inside of the finally assembled pillow case. The pillow case panel with attached appendages and bottom pillow case facing is then aligned with the 2nd pillow case panel so that the respective pillow case panel corners and outer perimeters are aligned. The two pillow case panels are then attached by means, usually by sewing or gluing, at the outer perimeter on the sides and top end. The pillow case panels and bottom pillow case facing are usually formed from a soft sheeting fabric, however, any fabric, plastic or other material sheeting may be used in accordance with the desires of the individual. The pillow case panel which has caricature animal appendages attached is usually formed from a washable imitation fur fabric. The remaining pillow case panel and the bottom pillow case facings are usually formed of washable cotton, cotton flannel, a cotton blend or polyester. However, any fabric, plastic or other sheeting material may be used in accordance with the desires of the individual.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
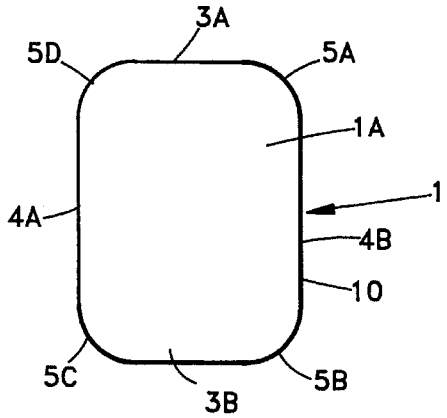
FIG. 1 is a view of the 1st surface of a pillow case panel.
Figure 1A:
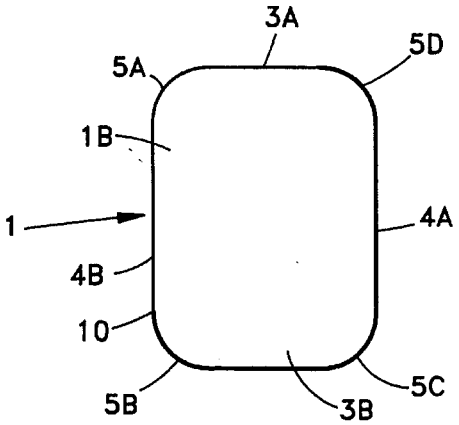
FIG. 1A is a view of the 2nd surface of a pillow case panel.
Figure 2:
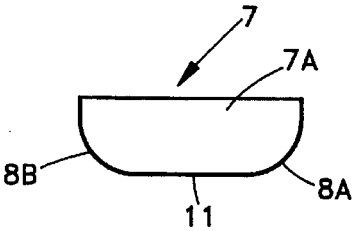
FIG. 2 is a view of the 1st surface of a bottom pillow case facing for a pillow case panel.
Figure 2A:
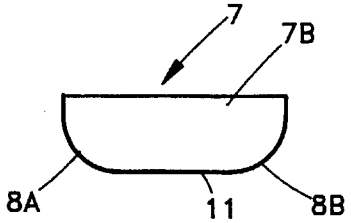
FIG. 2A is a view of the 2nd surface of a bottom pillow case facing for a pillow case panel.
Figure 3:
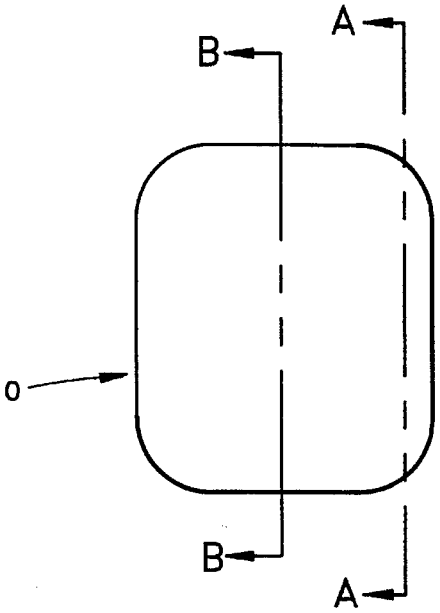
FIG. 3 is a plan view of the top of a pillow case as assembled for adoption of caricature character appendages.
Figures 4, 4A:
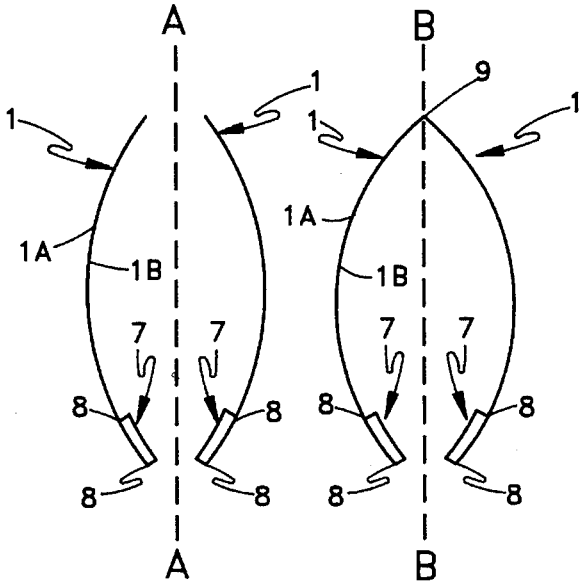
FIG. 4 is a section view B—B of the assembled pillow case showing the pillow case panels affixed at their perimeter and showing the bottom pillow case facing affixed at their perimeters to the pillow case panels.
FIG. 4A is a section view A—A of the assembled pillow case showing the pillow case panels affixed at their perimeter and showing the bottom pillow case facing affixed at their perimeters to the pillow case panels.
Figure 5:
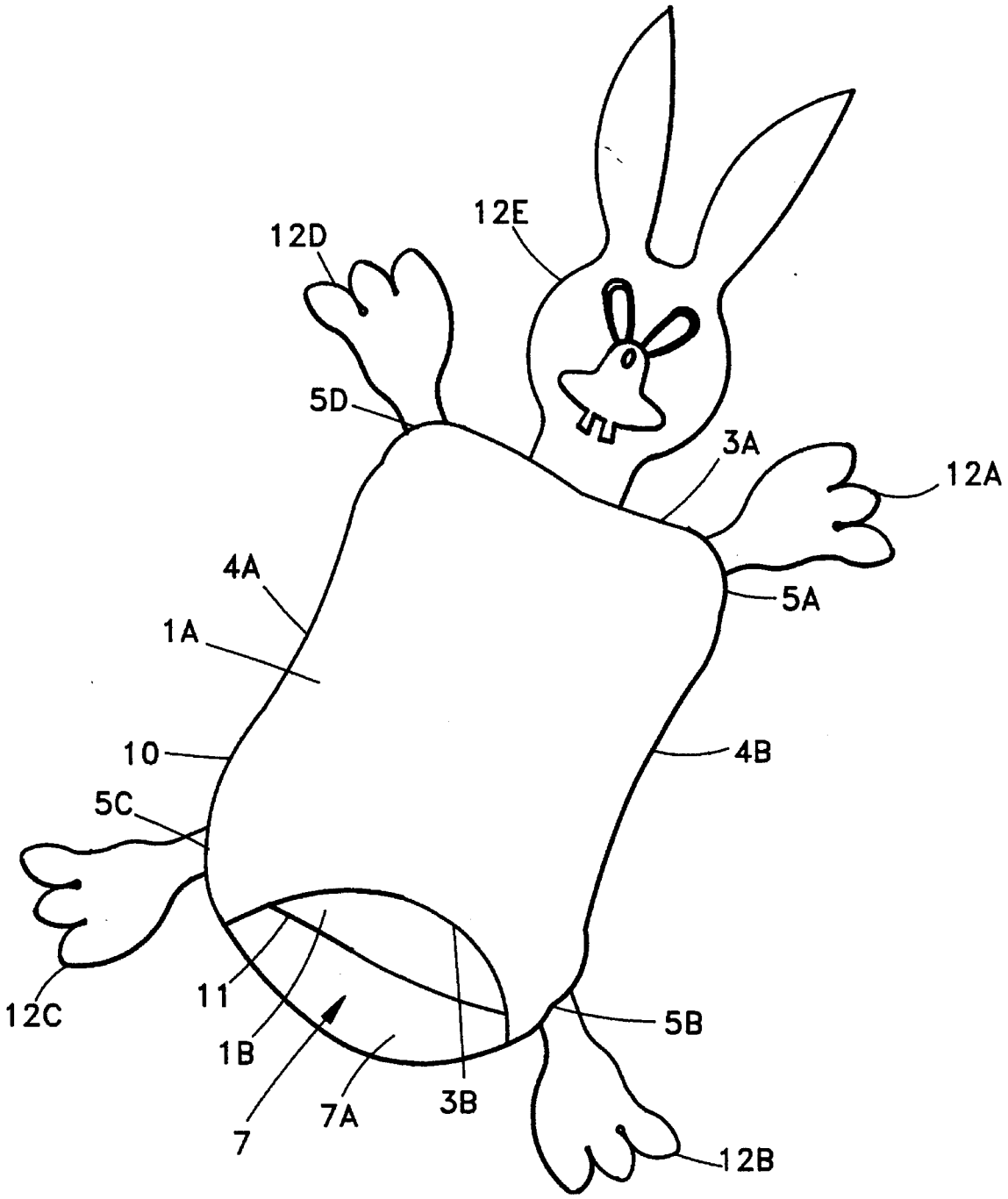
FIG. 5 is a view of the pillow case with "accommodated" appendages.

The pillow case panel FIG. 1 and 1A, bottom pillow case facing FIG. 2 and 2A and assembled pillow case FIG. 3 and 4, illustrate pillow case panel surface views, the bottom pillow case facing views and the top plan and cross section of an assembled pillow case and is the preferred embodiment wherein a pair of pillow case panels (1) are substantially rectangular in shape and have a 1st (1A) and a 2nd surface (1B), a top (3A) and a bottom end (3B) and a 1st (4A) and 2nd (4B) side. The rounded corners (5A, 5B, 5C, 5D) of each pillow case panel (1) are rounded to accommodate caricature animal or character appendages (12A, 12B, 12C, 12D, 12E).

A bottom pillow case facing (7) of the same width as the pillow case panel (1), has a 1st and a 2nd surface (7A, 7B), two rounded corners (8A, 8B) of the same configuration as the rounded corners (5A, 5B, 5C, 5D) of the pillow case panels (1) and a depth sufficient to cover animal or character caricature appendages (12A, 12B, 12C, 12D, 12E).

Each pillow case panel (1) and bottom pillow case facing (7) has an outer perimeter (10, 11). Caricature animal or character appendages (12A, 12B, 12C, 12D, 12E) are attached to a pillow case panel (1) at the corners (5A, 5B, 5C, 5D) and top end (3A). A bottom pillow case facing (7) overlays the bottom end of the pillow case panel (3B) and the caricature animal or character appendages (12A, 12B, 12C, 12D, 12E) attached to the surface (1B) of the pillow case panel (1) such that the bottom pillow case facing (7) rounded corners (8A, 8B) correspond to and are aligned with the rounded corners (5B, 5C) of the bottom end (3B) of the pillow case panel (1). The bottom pillow case facing (7) outer perimeter (11) is affixed (8) by means to the pillow case panel (1). The pillow case panel (1) with attached caricature animal or character appendages (12A, 12B, 12C, 12D, 12E) overlays the second pillow case panel (1) such that the respective pillow case panel rounded corners (5A, 5B, 5C, 5D), sides (4A, 4B), top (3A) and bottom ends (3B) and perimeters (10) are aligned. The outer perimeters (10) of the two pillow case panels (1) are affixed (9) by means to each other, with the exception of that portion of the outer perimeter at the bottom end (3B) of the pillow case panels (1), to allow the insertion of a pillow into the assembled pillow case (10).

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A pillow case including animal or other character caricature appendages comprising:

A. a pair of pillow case panels (1) each having a 1st and a 2nd surface (1A, 1B), a top and a bottom end (3A, 3B), a 1st and a 2nd side (4A, 4B), rounded corners (5A, 5B, 5C, 5D) and outer perimeters (10); a pair of bottom pillow case facings (7) each having a 1st and a 2nd surface (7A, 7B), corners (8A, 8B) and outer perimeters (11);

B. the bottom end (3B) of one pillow case panel (1) overlaid by a bottom pillow case facing (7) aligned so that the bottom pillow case facing corners (8A, 8B) are aligned with said rounded corners (5B, 5C) of the pillow case panel (1); said bottom pillow case facing (7) affixed by means to said pillow case panel (1) at the outer perimeter of said bottom pillow case facing (11) so as to accommodate caricature animal or character appendages (12B, 12C); appendages (12B, 12C) located at a plurality of rounded corners (5A, 5B, 5C, 5D), C. the bottom end (3B) of a second pillow case panel (1) overlaid by a bottom pillow case facing (7) aligned so that the bottom pillow case facing corners (8A, 8B) correspond to said rounded corners (5B, 5C) of the pillow case panel (1); said bottom pillow case facing (7) affixed by means to said pillow case panel (1) at the outer perimeter (11) of said bottom pillow case facing (7);

D. the said pillow case panel (1) with affixed caricature animal or character appendages (12A, 12B, 12C, 12D, 12E) overlays the second pillow case panel (1) such that the respective pillow case panel rounded corners (5A, 5B, 5C, 5D), 1st and 2nd sides (4A, 4B) and top and bottom ends (3A, 3B) are aligned and the bottom pillow case facings (7) are directed toward each other; the outer perimeters (10) of the respective pillow case panels (1) are affixed by means at the sides (4A, 4B) and top (3A).

2. A pillow case including animal or other character caricature appendages comprising:

A. a pair of pillow case panels (1) each having a 1st and a 2nd surface (1A, 1B), a top and a bottom end (3A, 3B), a 1st and a 2nd side (4A, 4B), rounded corners (5A, 5B, 5C, 5D) and outer perimeters (10); a pair of bottom pillow case facings (7) each having a 1st and a 2nd surface (7A, 7B), two rounded corners (8A, 8B) and outer perimeters (11);

B. the bottom end (3B) of one pillow case panel (1) overlaid by a bottom pillow case facing (7) aligned so that the bottom pillow case facing rounded corners (8A, 8B) are aligned with said rounded corners (5B, 5C) of the pillow case panel (1); said bottom pillow case facing (7) affixed by sewing to said pillow case panel (1) at the outer perimeter (11) of said bottom pillow case facing (7); said pillow case panel (1) to accommodate caricature animal or character appendages (12A, 12B, 12C, 12D, 12E) affixed at the pillow case panel rounded corners (5A, 5B, 5C, 5D) and at the top end (3A) of said pillow case panel (1); appendages (12B, 12C) located at a plurality of rounded corners (5A, 5B, 5C, 5D), C. the bottom end (3B) of a second pillow case panel (1) overlaid and by a bottom pillow case facing (7) aligned so that the bottom pillow case facing rounded corners (8A, 8B) correspond to said rounded corners (5B, 5C) of the pillow case panel (1); said bottom pillow case facing (7) affixed by sewing to said pillow case panel (1) at the outer perimeter (11) of said bottom pillow case facing (7);

D. the said pillow case panel (1) with affixed caricature animal or character appendages (12A, 12B, 12C, 12D, 12E) overlays the second pillow case panel (1) such that the respective pillow case panel rounded corners (5A, 5B, 5C, 5D), 1st and 2nd sides (4A, 4B) and top and bottom ends (3A, 3B) are aligned and the bottom pillow case facings (7) are directed toward each other; the outer perimeters of the respective pillow case panels (10) are affixed by sewing at the sides (4A, 4B) and top (3A).

3. A pillow case according to claim 2 wherein said pillow case panels (1) and said bottom pillow case facings (7) are affixed by gluing.

4. A pillow case including animal or other character caricature appendages comprising:

A. a pair of pillow case panels (1) each having a 1st and a 2nd surface (1A, 1B), a top and a bottom end (3A, 3B), a 1st and a 2nd side (4A, 4B), rounded corners (5A, 5B, 5C, 5D) and outer perimeters (10); a pair of bottom pillow case facings (7) each having a 1st and a 2nd surface (7A, 7B), two rounded corners (8A, 8B) and outer perimeters (11);

B. one pillow case panel (1) formed of imitation fur fabric such that the fur side of the fabric constitutes the 1st surface (1A) of said pillow case panel (1) and caricature animal or character appendages (12A, 12B, 12C, 12D, 12E) are affixed at the rounded corners (5A, 5B, 5C, 5D) and at the top end (3A) of the 2nd surface (1B) of said pillow case panel (1); the bottom end (3B) of the 2nd surface (1B) of said pillow case panel (1) overlaid by a bottom pillow case facing (7) aligned so that the bottom pillow case facing rounded corners (8A, 8B) are aligned with said rounded corners (5B, 5C) of the pillow case panel (1); said bottom pillow case facing (7) formed of cotton flannel sheeting and affixed by sewing to said pillow case panel (1) at the outer perimeter (11) of said bottom pillow case facing (7) so as to accommodate caricature animal or character appendages (12B, 12C) affixed between the 2nd surface (1B) of the pillow case panel (1) and the bottom pillow case facing (7) at the rounded corners (8A, 8B); appendages (12B, 12C) located at a plurality of rounded corners (5A, 5B, 5C, 5D), C. a second pillow case panel (1) formed of cotton flannel sheeting; the bottom end (3B) of said second pillow case panel (1) overlaid by a bottom pillow case facing (7) aligned so that the bottom pillow case facing rounded corners (8A, 8B) correspond to said rounded corners (5B, 5C) of the pillow case panel (1); said bottom pillow case facing (7) formed of cotton flannel sheeting and affixed by sewing to said pillow case panel (1) at the outer perimeter (11) of said bottom pillow case facing (7);

D. the said pillow case panel (1) with affixed caricature animal or character appendages (12A, 12B, 12C, 12D, 12E) overlays the second pillow case panel (1) such that the respective pillow case panel rounded corners (5A, 5B, 5C, 5D), 1st and 2nd sides (4A, 4B) and top and bottom ends (3A, 3B) are aligned and the bottom pillow case facings (7) are directed toward each other; the outer perimeters (10) of the respective pillow case panels (1) are affixed by sewing at the sides and top.

* * * * *